US007662243B2

(12) United States Patent
Yokoi et al.

(10) Patent No.: US 7,662,243 B2
(45) Date of Patent: Feb. 16, 2010

(54) HOT ROLLED STEEL SHEET

(75) Inventors: Tatsuo Yokoi, Oita (JP); Tetsuya Yamada, Oita (JP); Osamu Kawano, Oita (JP)

(73) Assignee: Nippon Steel Corporation, Tokyo (JP)

( * ) Notice: Subject to any disclaimer, the term of this patent is extended or adjusted under 35 U.S.C. 154(b) by 329 days.

(21) Appl. No.: 10/571,023

(22) PCT Filed: Sep. 2, 2004

(86) PCT No.: PCT/JP2004/013088

§ 371 (c)(1),
(2), (4) Date: Mar. 2, 2006

(87) PCT Pub. No.: WO2005/024082

PCT Pub. Date: Mar. 17, 2005

(65) Prior Publication Data

US 2006/0266445 A1 Nov. 30, 2006

(30) Foreign Application Priority Data

Sep. 5, 2003 (JP) ..... 2003-314590

(51) Int. Cl.
*C22C 38/02* (2006.01)
*C22C 38/04* (2006.01)
*C22C 38/06* (2006.01)

(52) U.S. Cl. ..... 148/320; 148/330; 148/331; 148/332; 148/333; 148/334; 148/335; 148/336; 428/659

(58) Field of Classification Search ..... 148/320, 148/602, 654, 533, 332–336; 420/128, 121, 420/104–112, 123–127; 428/659
See application file for complete search history.

(56) References Cited

U.S. PATENT DOCUMENTS 6,540,846 B2 * 4/2003 Kashima et al. ..... 148/320

FOREIGN PATENT DOCUMENTS

| | | |
|---|---|---|
| EP | 1227167 | 7/2007 |
| JP | 10-146602 | 6/1998 |
| JP | H10183301 | 7/1998 |

(Continued)

OTHER PUBLICATIONS

Toru Araki, "Recent Research on the Bainite Microstructures and Transformation Behavior of (Very) Low Carbon HSLA Steels", Bainite Research Committee, Society on Basic Research, Iron and Steel Institute of Japan, 1994.
Tadayoshi et al., "Impact Pressure of Water in Hydraulic Descaling During Hot Strip Mill Rolling", Iron and Steel, 1991 vol. 77 No. 9.

(Continued)

*Primary Examiner*—Deborah Yee
(74) *Attorney, Agent, or Firm*—Dorsey & Whitney LLP

(57) ABSTRACT

An exemplary hot rolled steel sheet can included, in terms of percent by mass, C of 0.01 to 0.2%; Si of 0.01 to 2%; Mn of 0.1 to 2%; P of ≦0.1%; S of ≦0.03%; Al of 0.001 to 0.1%; N of ≦ 0.01%; and as a remainder, Fe and unavoidable impurities. For example, a microstructure can be substantially a homogeneous continuous-cooled microstructure, and an average grain size of the microstructure may be more than 8 μm and 30 μm or less. An exemplary method for manufacturing a hot rolled steel sheet can include subjecting a slab having the above composition to a rough rolling so as to obtain a rough rolled bar, subjecting the rough rolled bar to a finish rolling so as to obtain a rolled steel under conditions in which a finishing temperature is (Ar3 transformation point +50° C.) or more; and starting cooling the rolled steel after 0.5 seconds or more pass from the end of the finish rolling at a temperature of the Ar3 transformation point or more. At least in the temperature range from the Ar3 transformation point can be cooled to 500° C. at a cooling rate of 80°C./sec or more, a further cooling can be effectuated until the temperature is 500° C. or less to obtain a hot rolled steel sheet and coiling the hot rolled steel sheet.

6 Claims, 2 Drawing Sheets

FOREIGN PATENT DOCUMENTS

| | | | |
|---|---|---|---|
| JP | 2000119831 | | 4/2000 |
| JP | 2000169935 | | 6/2000 |
| JP | 2000169936 | | 6/2000 |
| JP | 2000297350 | | 10/2000 |
| JP | 2001-303186 | * | 10/2001 |
| JP | 2001316762 | | 11/2001 |
| JP | 2002129279 | | 5/2002 |
| JP | 2003003239 | * | 1/2003 |
| JP | 2003-049243 | | 2/2003 |
| JP | 200349242 | | 2/2003 |
| JP | 2003-089847 | * | 3/2003 |
| JP | 2003113443 | | 4/2003 |

OTHER PUBLICATIONS

International Search Report for International Patent application No. PCT/US2004/013088.

International Written Opinion for International Patent application No. PCT/US2004/013088.

Supplementary EP Search Report for corresponding EP application No. 04772902.5.

Office Action of associated Korean Patent Application No. 10-2006-7004119 with English-language translation thereof.

English abstract of the Metal Material Fatigue Design Handbook, Society of Materials Science, Japan, p. 84.

* cited by examiner

HOT ROLLED STEEL SHEET

CROSS REFERENCE TO RELATED APPLICATION(S)

This application is a national stage application of PCT Application No. PCT/JP2004/013088 which was filed on Sep. 2, 2004 and published on Mar. 17, 2005 as International Publication No. WO 2005/024082 (the "International Application"), the entire disclosure of which is incorporated herein by reference. This application claims priority from the International Application pursuant to 35 U.S.C. § 365. The present application also claims priority under 35 U.S.C. § 119 from Japanese Patent Application No. 2003-314590, filed Sep. 5, 2003, the entire disclosure of which is incorporated herein by reference.

FIELD OF THE INVENTION

The present invention relates to a hot rolled steel sheet having bake hardenability (BH) and stretch flangability, and a method for manufacturing the same.

BACKGROUND INFORMATION

Use of light metals such as aluminum (Al) alloy and high-strength steel sheets for automobile members has been suggested for the purpose of reducing weight in order to improve automobile fuel consumption. The light metals such as Al alloy offer the advantage of high specific strength; however, since they are much more expensive than steel, their applications are limited to special applications. Thus, there may be a need to increase the strength of steel sheet to promote cost decreases and automobile weight reductions over a wider range.

Since increasing the strength of a material typically causes deterioration of moldability (processability) and other material characteristics, the key to developing high-strength steel sheet is the extent to which strength can be increased without deteriorating material characteristics. Since characteristics such as stretch flangability, ductility, fatigue durability and corrosion resistance are important characteristics that are preferred for a steel sheet used for inner plate members, structural members and underbody members, and how effectively these characteristics can be balanced with high strength on a high order may be important.

For example, Japanese Unexamined Patent Applications, First Publication Nos. 2000-169935 and 2000-169936 describes a transformation-induced plasticity (TRIP) steel in which moldability (ductility and deep drawability) are dramatically improved as a result causing the occurrence of TRIP phenomenon during molding by containing residual austenite in the microstructure of the steel in order to achieve both high strength and various advantageous characteristics, especially moldability.

The steel sheet obtained in such manner can demonstrate a breaking elongation in excess of 35% and superior deep drawability (limiting drawing ratio—LDR) due to the occurrence of TRIP phenomenon by the residual austenite at a strength level of about 590 MPa. However, amounts of elements such as C, Si and Mn should inevitably be reduced in order to obtain steel sheet having strength within the range of 370 to 540 MPa, and when the amounts of elements such as C, Si and Mn are reduced to realize the strength within the range of 370 to 540 MPa, there is the problem of likely being unable to maintain amount of residual austenite required for obtaining TRIP phenomenon in the microstructure at room temperature. In addition, the emphasis of the above art is not placed on improving stretch flangability. Thus, it may be difficult to apply high-strength steel sheet having strength of 540 MPa or higher to a member in which steel sheet having strength on the order of 270 to 340 MPa is currently used, without first improving operations and equipment used during pressing. The likely solution has been to use steel sheet having strength of about 370 to 490 MPa. On the other hand, a preference for a reduction of gauges has been increasing in order to achieve reduction in weight for an automobile body, and it is therefore it may be important to reduce the weight for the automobile body to maintain pressed product strength as much as possible, based on the premise of reducing gauges.

Bake-hardening (BH) steel sheet has described as a solution to these problems because it generally has a low strength during press molding and improves the strength of pressed products as a result of introducing stress due to pressing and subsequent baking finish treatment.

It may be effective to increase solute C and solute N so as to improve bake hardenability. However, increases in such solute elements present in the solid solution can worsen aging deterioration at normal temperatures. Consequently, it may be important to develop a technology that can allow both bake hardenability and resistance to aging deterioration at normal temperatures.

On the basis of the preferences described above, Japanese Unexamined Patent Applications, First Publication Nos. H10-183301 and 2000-297350 describe technologies for realizing both bake hardenability and resistance to aging deterioration at normal temperatures, in which bake hardenability is improved by increasing the amount of solute N, and the diffusion of solute C and solute N at normal temperatures is inhibited by an effect of increasing grain boundary surface area caused by grain refining of crystal grains.

However, the grain refining of crystal grains generally has the risk of deteriorating press moldability, while the addition of solute N has the risk of causing aging deterioration. In addition, despite the need for superior stretch flangability in the case of applying to underbody members and inner plate parts, since the microstructure includes ferrite-pearlite having a average crystal grain size of 8 μm or less, it is unsuitable with respect to stretch flangability.

SUMMARY OF EXEMPLARY EMBODIMENTS OF THE INVENTION

Exemplary embodiments of the present invention relate to a hot rolled steel sheet and a method for manufacturing the same, which can bake hardenability and provide stretch flangability that allow to obtain a stable BH amount of 50 MPa or more within a strength range of 370 to 490 MPa, together with superior stretch flangability. For example, certain exemplary embodiments of the present invention are directed to a hot rolled steel sheet having both bake hardenability and stretch flangability, and which has a uniform microstructure for realizing superior stretch flangability, and has bake hardenability that allows to manufacture pressed product having strength equivalent to that of the design strength in the case of applying 540 to 640 MPa-class steel sheet as a result of the introduction of pressing stress and baking finish treatment, even when the tensile strength of the hot rolled steel sheet is 370 to 490 MPa, and a method for manufacturing that steel sheet inexpensively and stably.

Exemplary embodiments of the present invention provide a steel sheet having a better bake hardenability and superior stretch flangability.

As a result, inventors of the present invention newly found that the following steel sheet is extremely effective, thereby leading to completion of the present invention. The steel sheet has C=0.01 to 0.2%, Si=0.01 to 2%, Mn=0.1 to 2%, P≦0.1%, S≦0.03%, Al=0.001 to 0.1%, N≦0.01%, and as a remainder, Fe and unavoidable impurities. The microstructure can be primarily a homogeneous continuous-cooled microstructure and an average crystal grain size of the microstructure is greater than 8 μm and 30 μm or less.

According to an exemplary embodiment of the present invention, a hot rolled steel sheet can include, in terms of percent by mass, C of 0.01 to 0.2%; Si of 0.01 to 2%; Mn of 0.1 to 2%; P of ≦0.1%; S of ≦0.03%; Al of 0.001 to 0.1%; N of ≦0.01%; and as a remainder, Fe and unavoidable impurities. A microstructure can be substantially a homogeneous continuous-cooled microstructure, and an average crystal grain size of the microstructure is greater than 8 μm and 30 μm or less.

In accordance with such exemplary embodiment of the present invention, a hot rolled steel sheet can have a superior bake hardenability and a superior stretch flangability. Since BH amount of 50 MPa or more can be stably obtained over a strength range of 370 to 490 MPa with this hot rolled steel sheet, pressed product strength can be realized which is equivalent to the design strength in the case of applying 540 to 640 MPa-class steel sheet by introduction of pressing stress and baking finish treatment, even when the steel sheet has tensile strength of 370 to 490 MPa. Thus, the use of these exemplary steel sheets can enable even parts having strict stretch flangability requirements to be molded easily. In this manner, the exemplary embodiments of the present invention can have a high industrial value.

Such exemplary embodiment of the steel sheet in accordance with the present invention may further include, in terms of percent by mass, one or more selected from B of 0.0002 to 0.002%, Cu of 0.2 to 1.2%, Ni of 0. I to 0.6%, Mo of 0.05 to 1%, V of 0.02 to 0.2% and Cr of 0.01 to 1%.

This exemplary embodiment of the steel sheet in accordance with the present invention may further include, in terms of percent by mass, one or two of Ca of 0.0005 to 0.005% and REM of 0.0005 to 0.02%. Here, REM represents a rare earth metal, and refers to one or more selected from Sc, Y and lanthanides consisting of La, Ce, Pr, Nd, Pm, Sm, Eu, Gd, Tb, Dy, Ho, Er, Tm, Yb and Lu. Such exemplary steel sheet may be treated with zinc plating.

A method for manufacturing a hot rolled steel sheet according to an exemplary embodiment of the present invention can include subjecting a slab having: in terms of percent by mass, C of 0.01 to 0.2%; Si of 0.01 to 2%; Mn of 0.1 to 2%; P of ≦0.1%; S of ≦0.03%; Al of 0.001 to 0.1%; N of ≦0.01%; and as a remainder, Fe and unavoidable impurities to a rough rolling so as to obtain a rough rolled bar. In addition, the rough rolled bar can be subjected to a finish rolling so as to obtain a rolled steel under conditions in which a finishing temperature is (Ar3 transformation point +50° C.) or more. The rolled steel can be started to cool after about 0.5 seconds or more pass from the end of the finish rolling at a temperature of the Ar3 transformation point or more. The cooling can be performed at least in the temperature range from the Ar3 transformation point to 500° C. at a cooling rate of 80° C./sec or more. Further cooling can take place until the temperature is 500° C. or less to obtain a hot rolled steel sheet and coiling the hot rolled steel sheet.

According to the exemplary embodiment of the present invention, a starting temperature of the finish rolling may be set to 1000° C. or higher. Further, the rough rolled bar or the rolled steel may be heated during the time until the start of the step of subjecting the rough rolled bar to the finish rolling and/or during the step of subjecting the rough rolled bar to the finish rolling. A descaling procedure may be carried out during the time from the end of the step of subjecting the slab to the rough rolling to the start of the step of subjecting the rough rolled bar to the finish rolling. The resulting hot rolled steel sheet may be immersed in a zinc plating bath so as to galvanize the surface of the hot rolled steel sheet. In addition, an alloying treatment may be carried out after galvanizing.

These and other objects, features and advantages of the present invention will become apparent upon reading the following detailed description of embodiments of the invention, when taken in conjunction with the appended claims.

BRIEF DESCRIPTION OF THE DRAWINGS

Further objects, features and advantages of the invention will become apparent from the following detailed description taken in conjunction with the accompanying figure showing illustrative embodiments, results and/or features of the exemplary embodiment(s) of the present invention, in which.

DETAILED DESCRIPTION OF EXEMPLARY EMBODIMENTS OF INVENTION

Figure 1A:
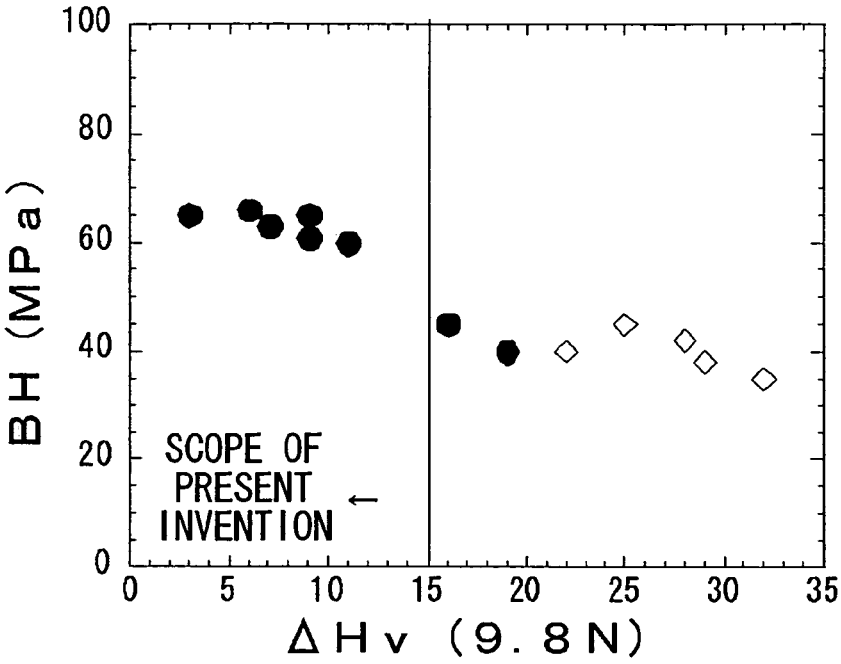
FIG. 1A is a graph showing an exemplary relationship between BH amount and a difference in an average Vickers hardness (ΔHv) of a microstructure.

The following provides an exemplary description of exemplary embodiments of the present invention with reference to the drawings. However, it should be understood that the present invention is not limited to each of these exemplary embodiments, and/or for example, certain constituent features of these exemplary embodiments may be suitably combined.

The following experiment was conducted to investigate the relationships among bake hardenability, stretch flangability and steel sheet microstructure. Slabs having the steel components shown in Table 1 were melted to prepare steel sheets having a thickness of 2 mm produced in various production processes, and then their bake hardenability, stretch flangability and microstructure were examined.

TABLE 1

(% by mass)

| C | Si | Mn | P | S | Al | N |
|---|---|---|---|---|---|---|
| 0.068 | 0.061 | 1.22 | 0.009 | 0.003 | 0.015 | 0.0029 |

Bake hardenability was evaluated in accordance with the following procedure. No. 5 test pieces as described in JIS Z 2201 were cut out of each steel sheet, preliminary tensile strain of 2% was applied to the test pieces, and then the test pieces were subjected to heat treatment corresponding to a baking finish treatment at 170° C. for 20 minutes, after which the tensile test was carried out again. The tensile test was carried out in accordance with the method of JIS Z 2241.

Here, the BH amount is defined as the value obtained by subtracting a flow stress of the preliminary tensile strain of 2% from the upper yield point obtained in the repeated tensile test.

Stretch flangability was evaluated using the hole expanding ratio in accordance with the hole expanding test method described in Japan Iron and Steel Federation Standard JIS T 1001-1996.

On the other hand, microstructure was investigated in accordance with the following method. Samples cut out from a location of ¼W or ¾W of the width (W) of the steel sheets were ground along the cross-section in the direction of rolling, and then were etched using a nital reagent. Photographs were taken of the fields at ¼t and ½t of the sheet thickness (t) and at a depth of 0.2 mm below a surface layer at 200-fold to 500-fold magnification using a light microscope.

Volume fraction of the microstructure is defined as the surface fraction in the aforementioned photographs of the metal structure. Next, a measurement of average crystal grain size of continuous-cooled microstructure was carried out by intentionally using the cutting method described in JIS G 0552, which is inherently used to determine crystal grain size of polygonal ferrite grains. Value m of the crystal grains per 1 $mm^2$ of the cross-sectional area was calculated from grain size number G determined from the measured values obtained by that cutting method using the equation of $m=8\times2^G$. Thereafter, the average crystal grain size $d_m$ obtained from this value of m using the equation of $d_m=1/\sqrt{m}$ is defined as the average crystal grain size of the continuous-cooled microstructure.

In the present exemplary case, the continuous-cooled microstructure (Zw) can refer to a microstructure that is defined as a transformation structure at an intermediate stage between a microstructure that contains polygonal ferrite and pearlite formed by a diffusion mechanism, and martensite formed by a shearing mechanism in the absence of diffusion as described in "Recent Research on the Bainite Structure of Low Carbon Steel and its Transformation Behavior—Final Report of the Bainite Research Committee", Bainite Research Committee, Society on Basic Research, the Iron and Steel Institute of Japan, 1994, the Iron and Steel Institute of Japan.

For example, as described on sections 125-127 of the above-described reference in terms of the structure observed by light microscopy, a continuous-cooled microstructure (Zw) can be defined as a microstructure which mainly includes bainitic ferrite ($\alpha^o{}_B$), granular bainitic ferrite ($\alpha_B$) and quasi-polygonal ferrite ($\alpha_q$), and additionally includes small amounts of residual austenite ($\gamma_r$) and martensite-austenite (MA).

For $\alpha_q$, internal structure does not appear as a result of etching in the same manner as polygonal ferrite (PF), $\alpha_q$ may have an acicular form, and can be distinguished from PF. In this manner, when the boundary length of the target crystal grain is taken to be lq and its equivalent circular diameter is taken to be dq, grains in which their ratio of (lq/dq) satisfies the relationship of $lq/dq \geqq 3.5$ are $\alpha_q$.

The continuous-cooled microstructure (Zw) in an exemplary embodiment of the present invention can be defined as a microstructure including any one or two or more of $\alpha^o{}_B$, $\alpha_B$, $\alpha_q$, $\gamma_r$ and MA, provided that the total small amount of $\gamma_r$ and MA is 3% or less.

Whether a uniform continuous-cooled microstructure is obtained is confirmed by the difference in average Vickers hardness at ¼t and ½t of the sheet thickness (t) and at a depth of 0.2 mm below the surface layer, along with observing the microstructure as described above. In the present invention, uniformity is defined as a state in which a difference in this average Vickers hardness (ΔHv) is 15 Hv or less. In this manner, the average Vickers hardness refers to the average value obtained by measuring at least 10 points at a test load of 9.8 N using the method described in JIS Z 2244, and determining the average value after excluding their respective maximum and minimum values.

Figure 1B:
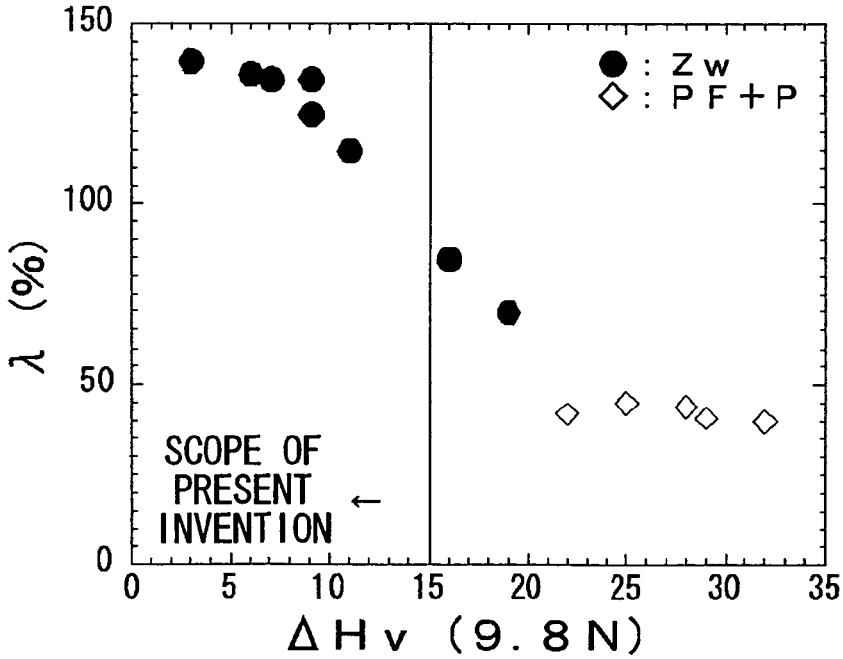
FIG. 1B is a graph showing an exemplary relationship between hole expanding ratio (λ) and the difference in the average Vickers hardness (ΔHv) of the microstructure.
Figure 2:
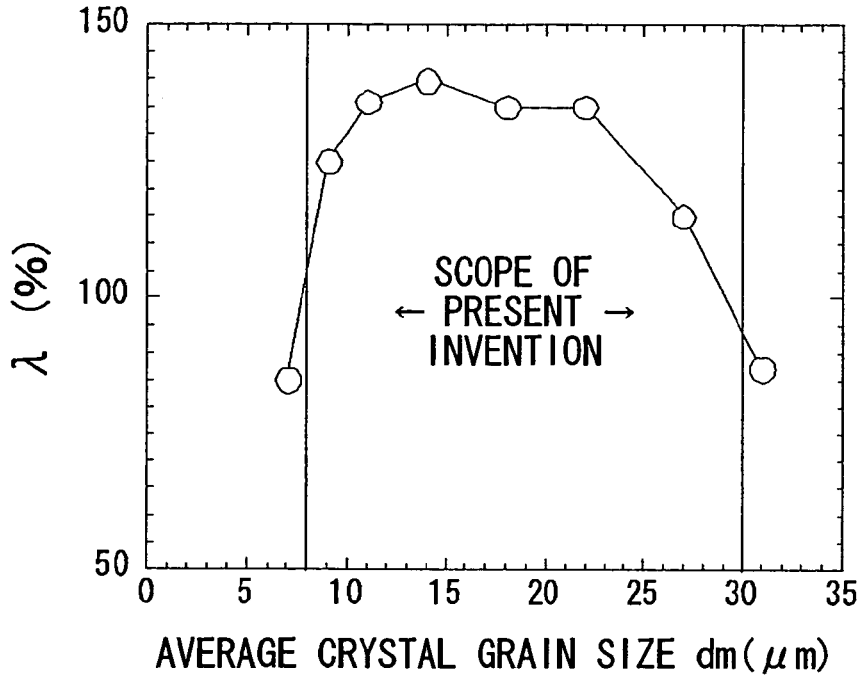
FIG. 2 is a graph showing an exemplary relationship between hole expanding ratio (λ) and the average crystal grain size ($d_m$) of a continuous-cooled microstructure.

Among results of BH amount and hole expanding ratio measured by the above described methods, FIG. 1A shows an exemplary relationship between BH amount and the difference in the average Vickers hardness (ΔHv) for each microstructure, FIG. 1B shows an exemplary relationship between hole expanding ratio (λ) and the difference in the average Vickers hardness (ΔHv) for each microstructure. FIG. 2 shows an exemplary relationship between hole expanding ratio (λ) and the average crystal grain size ($d_m$) of the continuous-cooled microstructure.

In FIGS. 1A and 1B, the black marks indicate results of hot rolled steel sheets in which the microstructure mainly includes a continuous-cooled microstructure (Zw), while the white marks indicate results of hot rolled steel sheets in which the microstructure is composed of polygonal ferrite (PF) and pearlite (P).

The difference in average Vickers hardness (ΔHv) demonstrates an extremely strong correlation with BH amount and hole expanding ratio (λ). In the case in which ΔHv is 15 or less, namely in the case in which the microstructure is a uniform continuous-cooled microstructure, in particular, high values can be achieved for both BH amount and hole expanding ratio (λ), and as shown in FIG. 2, even in the case of a continuous-cooled microstructure, it was newly found that hole expanding ratio (λ) is even better in the case in which the average crystal grain size ($d_m$) is greater than 8 μm and 30 μm or less.

It is believed that the microstructure becomes continuous-cooled microstructure (Zw) as a result of inhibition of the precipitation of carbides due to diffusion of Fe, and this inhibition of the precipitation of carbides in turn leads to increase amount of solute C, which improves the BH amount. In addition, this continuous-cooled microstructure (Zw) becomes a uniform, and there likely does not exist interfaces between hard phases and soft phases which cause generation sources for voids that act as origins of stretch-flange cracks. Furthermore, the precipitation of carbides that act as origins of stretch-flange cracks is suppressed or the precipitates become finer. Therefore, the stretch flangability is likely to be superior.

However, in the case in which the average crystal grain size is 8 μm or less, it is presumed that the uniformity of the microstructure is impaired (for example, effects of carbides included in the microstructure becomes prominent) and the hole expanding ratio tends to decrease. Moreover, in the case in which the average crystal grain size is 8 μm or less, the yield point rises, resulting in the risk of causing processability to deteriorate.

According to the exemplary embodiment of the present invention, not only is the BH amount at the preliminary strain of 2% superior evaluated as previously described, but also the BH amount at the preliminary strain of 10% is 30 MPa or more, and an amount of increase in tensile strength (ΔTS) at the preliminary strain of 10% is 30 MPa or more.

The following provides a detailed explanation of the microstructure of a steel sheet in accordance with an exemplary embodiment of the present invention.

In order to satisfy both of bake hardenability and stretch flangability, it is preferable that the microstructure mainly includes a uniform continuous-cooled microstructure and that the average crystal grain size is greater than 8 μm. Moreover, since the hole expanding ratio tends to decrease in the case in which the average crystal grain size is greater than 30 μm, the upper limit of the average crystal grain size should be 30 μm. It is preferable that the average crystal grain size is 25 μm or less from the viewpoint of surface roughness and so forth.

In the case in which the microstructure mainly includes a uniform continuous-cooled microstructure, in order to realize both superior bake hardenability and superior stretch flangability, the continuous-cooled microstructure preferably has the characteristics described above, and the entire microstructure is preferably a continuous-cooled microstructure. Although the characteristics of the microstructure of steel sheet are not significantly deteriorated even if the microstructure includes polygonal ferrite other than a continuous-cooled microstructure, it is preferable that the amount of polygonal ferrite is at a maximum of 20% or less so as to prevent deterioration of stretch flangability.

In a hot rolled steel sheet of the present invention, the maximum height Ry of the steel sheet surface is preferably 15 μm (15 μm Ry, 12.5 mm, ln 12.5 mm) or less. This can be because, as is described, for example, on page 84 of the Metal Material Fatigue Design Handbook, Society of Materials Science, Japan, the fatigue strength of hot rolled or acid washed steel sheet is clearly correlated with the maximum height Ry of the steel sheet surface.

The following provides an explanation of the reason for limiting the chemical components of certain exemplary embodiments of the present invention.

C is one of the important elements in the exemplary embodiment of the steel sheet in accordance with the present invention. In the case in which the content of C is more than 0.2%, not only does amount of carbides acting as origins of stretch-flange cracks increase, resulting in deterioration of hole expanding ratios, but also strength ends up increasing, resulting in poor processability. Consequently, the content of C can be made to be 0.2% or less. It may be preferable that the content of C is less than 0.1% in consideration of ductility. Further, in the case in which the content of C is less than 0.01%, continuous-cooled microstructure may not necessarily be obtained, resulting in the risk of decreasing the BH amount. Therefore, the content of C can be made to be 0.01% or more.

Si and Mn are important elements in the exemplary embodiment of the steel sheet in accordance with the present invention. They should be contained in specific amounts in order to realize steel sheet in which the required continuous-cooled microstructure of the exemplary embodiment of the present invention is included, while having low strength of 490 MPa or less.

Mn has the effect of expanding the temperature range of the austenite region towards lower temperatures and facilitates the obtaining of the required continuous-cooled microstructure of the exemplary embodiment of the present invention during cooling following completion of rolling. Therefore, Mn is included at a content of 0.1% or more. However, since the effect of Mn is saturated when included at a content of more than 2%, the upper limit of the content of Mn is made to be 2%.

On the other hand, since Si has the effect of inhibiting the precipitation of iron carbides that act as origins of stretch-flange cracks during cooling, Si is included at a content of 0.01% or more. However, its effect is saturated when included at a content of more than 2%. Thus, the upper limit of the content of Si is made to be 2%. Moreover, in the case in which the content of Si is more than 0.3%, there is the risk of causing deterioration of processability for phosphating. Therefore, the upper limit of the content of Si is preferably 0.3%.

In addition, in the case in which elements other than Mn that inhibit occurrence of hot cracks due to S are not adequately included, Mn is preferably included so that the contents of Mn and S satisfy Mn/S>20 in terms of percent by mass. Moreover, in the case in which Mn is included so that the contents of Si and Mn satisfy Si+Mn of more than 1.5%, strength becomes excessively high, and this causes deterioration of processability. Therefore, the upper limit of the content of Mn is preferably 1.5%.

P is an impurity and its content should be as low as possible. In the case in which the content of P is more than 0.1%, P causes negative effects on processability and weldability. Therefore, the content of P should be 0.1% or less. However, it is preferably 0.02% or less in consideration of hole expanding and weldability.

Since S not only causes cracking during hot rolling but also forms A type inclusions that cause deterioration of hole expanding if excessively large amount of S is present, the content of S should be made to be as low as possible. Allowable range for the content of S is 0.03% or less. However, in cases in which a certain degree of hole expansion is required, it is preferable that the content of S is 0.01% or less, and in cases in which a high degree of hole expansion is required, it is preferable that the content of S is 0.003% or less.

Al should be included at a content of 0.001% or more for the purpose of deoxidation of molten steel; however, its upper limit is made to be 0.1% since Al leads to increased costs. In addition, since Al causes increases in amount of non-metallic inclusions resulting in deterioration of elongation if excessively large amount of Al is included, it is, preferable that the content of Al is 0.06% or less. Moreover, it is preferable that the content of Al is 0.015% or less in order to increase the BH amount.

N is typically a preferable element for increasing the BH amount. However, since its effect is saturated even if N is included at a content of more than 0.01%, the upper limit of the content of N is 0.01%. In the case of applying to parts for which aging deterioration presents a problem, since aging deterioration becomes considerable if N is included at a content of more than 0.006%, the content of N is preferably 0.006% or less. Moreover, in the case of being premised on allowing to stand for two weeks or more at room temperature after production and then using for processing, the content of N is preferably 0.005% or less from the viewpoint of aging. In addition, the content of N is preferably less than 0.003% when considering allowing to stand at high temperatures during the summer or when exporting across the equator during transport by a marine vessel.

B improves quench hardenability, and can be effective in facilitating the obtaining of the required continuous-cooled microstructure of feature of the exemplary embodiment of the present invention. Therefore, B can be included if needed. However, in the case in which the content of B is less than 0.0002%, the content may not be adequate for obtaining that effect, while in the case in which the content of B is more than 0.002%, its effect becomes saturated. Accordingly, the content of B can be made to be 0.0002% to 0.002%.

Moreover, for the purpose of imparting strength, any one or two or more of alloying elements for precipitation or alloying elements for solid solution may be included that are selected from Cu at a content of 0.2 to 1.2%, Ni at a content of 0.1 to 0.6%, Mo at a content of 0.05 to 1%, V at a content of 0.02 to 0.2% and Cr at a content of 0.01 to 0.1%. In the case in which the contents of any of these elements are less than the aforementioned ranges, its effect may not be obtained. In the case in which their contents exceed the aforementioned ranges, the effect becomes saturated and there are no further increases in effects even if the contents are increased.

Ca and REM are elements which change forms of non-metallic inclusions acting as origins of breakage and causing deterioration of processability, and then eliminate their harmful effects. However, they are not effective if included at contents of less than 0.0005%, while their effects are saturated if Ca is included at a content of more than 0.005% or REM is included at a content of more than 0.02%. Consequently, Ca is preferably included at a content of 0.0005 to 0.005%, while REM is preferably included at a content of 0.0005 to 0.02%.

In this manner, the steel having these for their main components may further include Ti, Nb, Zr, Sn, Co, Zn, W or Mg on condition that the total content of these elements is 1% or less. However, since there may be a risk of Sn causing imperfections during hot rolling, the content of Sn is preferably 0.05% or less.

The following provides a detailed description of an exemplary reason for limiting the method for manufacturing a hot rolled steel sheet according to the exemplary embodiment of the present invention.

A hot rolled steel sheet according to a further exemplary embodiment of the present invention can be manufactured by a method in which slabs are hot rolled after casting and then cooled, a method in which a rolled steel or hot rolled steel sheet after hot rolling is further subjected to heat treatment on a hot-dip coating line, or a method which further includes other surface treatment on these steel sheets.

The method for manufacturing a hot rolled steel sheet according to the exemplary embodiment of the present invention includes a procedure for subjecting a slab to a hot rolling so as to obtain a hot rolled steel sheet, and includes a rough rolling procedure of rolling the slab so as to obtain a rough rolled bar (also referred to as a sheet bar), a finish rolling step of rolling the rough rolled bar so as to obtain a rolled steel, and a cooling procedure so as to cool the rolled steel to obtain the hot rolled steel sheet.

There are no particular limitations on the exemplary manufacturing method carried out prior to hot rolling, that is, a method for manufacturing a slab. For example, slabs may be manufactured by melting using a blast furnace, a converter or an electric arc furnace, followed by conducting various types of secondary refining for adjusting the components so as to have the target component contents, and then casting using a method such as ordinary continuous casting, casting using the ingot method or thin slab casting. Scrap may be used for the raw material. In the case of using slabs obtained by the continuous casting, hot cast slabs may be fed directly to a hot rolling machine, or the slabs may be hot rolled after cooling to room temperature and then reheating in a heating oven.

There are no particular limitations on the temperature for reheating the slabs; however, in the case in which the temperature is 1400° C. or higher, the amount of scale removed becomes excessive, resulting in a decrease in yield. Therefore, the reheating temperature is preferably lower than 1400° C. In addition, in the case of heating at a temperature of lower than 1000° C., operating efficiency is considerably impaired in terms of scheduling. Therefore, the reheating temperature for the slabs is preferably 1000° C. or higher. Moreover, in the case of reheating at a temperature of lower than 1100° C., the amount of scale removed becomes small, thereby there is a possibility that inclusions in the surface layer of the slab can not be removed together with the scales by subsequent descaling. Therefore, the reheating temperature for the slabs is preferably 1100° C. or higher.

The hot rolling procedure can include a rough rolling step and a finish rolling step carried out after completion of that rough rolling, and a starting temperature of the finish rolling is preferably 1000° C. or higher, and more preferably 1500° C. or higher, in order to obtain a more uniform continuous-cooled microstructure in a direction of the sheet thickness. In order to accomplish this, it may be preferable to heat the rough rolled bar or the rolled steel during the time from the end of the rough rolling to the start of the finish rolling and/or during the finish rolling, as preferable.

In order to obtain stable and superior breaking elongation in particular in the present invention, it may be effective to inhibit the fine precipitation of MnS and so forth. Normally, precipitates such as MnS are redissolved in a solid solution during reheating of the slabs at about 1250° C., and finely precipitate during subsequent hot rolling. Thus, ductility can be improved by controlling the reheating temperature of the slabs to about 1150° C. so as to prevent MnS from being redissolved in the solid solution.

In the case of carrying out descaling during the time from the end of the rough rolling to the start of the finish rolling, it is preferable that collision pressure P (MPa) and flow rate L (liters/cm$^2$) of high-pressure water on the surface of the steel sheet satisfy the conditional expression of $P \times L \geqq 0.0025$.

The collision pressure P of the high-pressure water on the surface of the steel sheet is described in the following manner (see "Iron and Steel", 1991, Vol. 77, No. 9, p. 1450).

$$P(MPa)=5.64=P_0 \times V/H^2$$

where, $P_0$ (MPa): Liquid pressure

V (liters/min): Flow rate of liquid from nozzle

H (cm): Distance between surface of steel sheet and nozzle

Flow rate L is described in the following manner.

$$L(liters/cm^2)=V/(W \times v)$$

where,

V (liters/min): Flow rate of liquid from nozzle

W (cm): Width of spraying liquid that contacts the surface of the steel sheet per nozzle v (cm/min): Sheet transport speed It is not necessary to specify the upper limit of value of collision pressure P×flow rate L in order to obtain the effects of the present invention; however, the upper limit of the value of collision pressure P×flow rate L is preferably 0.02 or less, since excessive nozzle wear and other problems can occur when the nozzle liquid flow rate is increased.

It is preferable to remove scale by descaling the surface of the steel sheet so that the maximum height Ry of the surface of the steel sheet after finish rolling is 15 μm (15 μm Ry, 12.5 mm, ln 12.5 mm) or less.

In addition, the subsequent finish rolling is preferably carried out within 5 seconds after the descaling so as to prevent reformation of scale.

In addition, sheet bars may be joined between the rough rolling and the finish rolling, and the finish rolling may be carried out continuously. At that time, the rough rolled bar may be temporarily coiled into the shape of a coil, put in a cover having a warming function if necessary, and then joined after uncoiling.

The finishing temperature (FT) at completion of the finish rolling should be ($Ar_3$ transformation point temperature+50° C.) or more. Here the $Ar_3$ transformation point temperature is simply indicated with, for example, the relationship with the steel components in accordance with the following calculation formula. Namely, $Ar_3$=910−310 ×% C+25×% Si−80×%

Mneq, where Mneq=% Mn+% Cr+% Cu+% Mo+% Ni/2+10(% Nb−0.02), or in the case of including B, Mneq=% Mn+% Cr+% Cu+% Mo+% Ni/2+10(% Nb−0.02)+1.

Here, the parameters of % C, % Si, % Mn, % Cr, % Cu, % Mo, % Ni, and % Nb in the formula indicate the respective contents (mass %) of elements C, Si, Mn, Cr, Cu, Mo, Ni and Nb in the slabs.

In the case in which the finishing temperature (FT) at completion of the finish rolling is lower than ($Ar_3$ transformation point temperature+50° C.), ferrite transformation proceeds easily, and the target microstructure can not be obtained. Therefore, FT is ($Ar_3$ transformation point temperature+50° C.) or more. The upper limit does not have to be provided for the finishing temperature (FT) at completion of finish rolling. However, in order to obtain FT of higher than ($Ar_3$ transformation point temperature+200° C.), a large burden is placed on equipments by maintaining the temperature of a furnace as well as heating the rough rolled bar or the rolled steel during the time from the end of rough rolling to the start of finish rolling and/or during finish rolling. Therefore, the upper limit of FT is preferably ($Ar_3$ transformation point temperature+200° C.).

In order to make the finishing temperature at completion of rolling within the range of the present invention, it is an effective means to heat the rough rolled bar or the rolled steel during the time from the end of rough rolling to the start of finish rolling and/or during finish rolling. Thus, for the heating, any type of system may be used for the heating apparatus; however, a transverse induction heating, which enables heating uniformly in the direction of thickness, may be preferable rather than a solenoid induction heating, during which the surface temperature rises easily.

After the completion of the finish rolling, the steel sheet may be cooled at a cooling rate of 80° C./sec or more over a temperature range from the $Ar_3$ transformation point temperature to 500° C.; however, ferrite transformation proceeds easily, and the target microstructure can be unobtainable unless cooling is started at a temperature equal to or above the $Ar_3$ transformation point temperature. Thus, the cooling may be started at a temperature equal to or above the $Ar_3$ transformation point. Moreover, the cooling rate is preferably. 130° C./sec or more so as to obtain a uniform microstructure. Additionally, in the case in which cooling is interrupted at a temperature of 500° C. or higher, ferrite transformation again proceeds easily, resulting in the risk of being unable to obtain the target microstructure.

Figure 3:
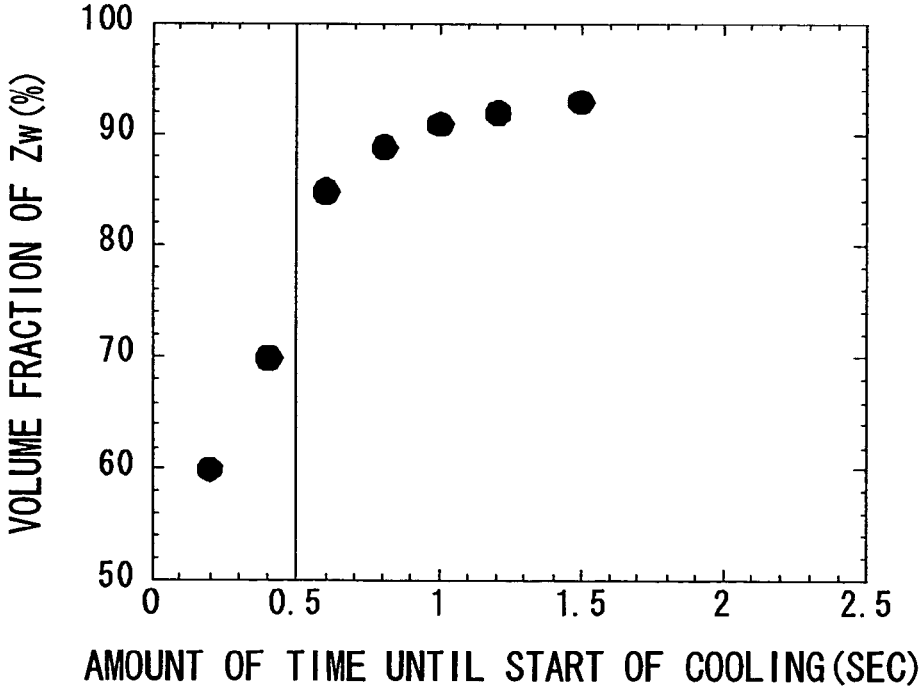
FIG. 3 is a graph showing an exemplary relationship between the volume fraction of a Zw structure and the amount of time from an end of finish rolling to a start of cooling.

However, in the case in which cooling is started within 0.5 seconds after completion of finish rolling, austenite recrystallization and grain growth become inadequate; thereby, ferrite transformation proceeds, resulting in the risk of being unable to obtain the target microstructure as shown in FIG. 3. Therefore, cooling can be started after 0.5 seconds passes from completion of finish rolling. The upper limit of the amount of time between the end of finish rolling and the start of cooling is not particularly specified, provided that the temperature is equal to or above the $Ar_3$ transformation point; however, since effects are saturated if the amount of time is 5 seconds or longer, the upper limit is 5 seconds or less.

In addition, in the case in which the cooling rate is less than 80° C./sec, ferrite transformation can proceed, thereby the target microstructure can not be obtained, and adequate bake hardenability is unable to be secured. Thus, the cooling rate may be 80° C./sec or more. The effects of the present invention can be obtained without particularly specifying the upper limit of the cooling rate; however, since there is concern about warp in the steel sheet due to thermal strain, it is preferably 250° C./sec or less.

In the case in which the coiling temperature is higher than 500° C., diffusion of C easily occurs at this temperature range. Thus, solute C that enhances bake hardenability may not be adequately secured. Therefore, the coiling temperature may limited to 500° C. or lower. The lower limit value of coiling temperature is not particularly specified; however, since the steel sheet changes shape due to thermal strain and so forth during cooling if the coiling temperature is lower than 350° C., it is preferably 350° C. or higher.

After completion of the hot rolling step, acid washing may be carried out if necessary, and then skinpass at a reduction rate of 10% or less, or cold rolling at a reduction rate of up to about 40% may be carried out either offline or inline. Furthermore, skinpass rolling is preferably carried out at 0.1% to 0.2% so as to correct the shape of the steel sheet and to improve ductility due to introduction of mobile dislocations.

In order to subject hot rolled steel sheet after acid washing to zinc plating, hot rolled steel sheet may be immersed in a zinc plating bath and if necessary, subjected to alloying treatment.

EXAMPLES

The following provides a more detailed explanation of certain exemplary embodiments of the present invention through its examples.

After steels A to J and X having the chemical components shown in Table 2 were melted using a converter and were subjected to continuous casting, they were either sent directly to rough rolling or reheated prior to rough rolling, and then were subjected to rough rolling and finishing rolling so as to make sheet thickness 1.2 to 5.5 mm, and were coiled. The chemical compositions shown in the table are indicated in percent by mass (mass %).

TABLE 2

| Slab | Chemical Composition (mass %) | | | | | | | |
|---|---|---|---|---|---|---|---|---|
| No. | C | Si | Mn | P | S | Al | N | Other |
| A | 0.085 | 0.01 | 1.17 | 0.009 | 0.001 | 0.016 | 0.0017 | |
| B | 0.070 | 1.02 | 0.36 | 0.008 | 0.001 | 0.035 | 0.0041 | |
| C | 0.070 | 0.03 | 1.26 | 0.012 | 0.001 | 0.015 | 0.0084 | |
| D | 0.048 | 0.22 | 0.72 | 0.010 | 0.001 | 0.033 | 0.0038 | Cu: 0.29%, Ni: 0.12% |
| E | 0.074 | 0.07 | 1.01 | 0.011 | 0.001 | 0.028 | 0.0027 | B: 0.004%, Cr: 0.08% |
| F | 0.051 | 0.04 | 0.98 | 0.009 | 0.001 | 0.031 | 0.0029 | Mo: 0.11% |
| G | 0.072 | 0.05 | 1.08 | 0.009 | 0.001 | 0.016 | 0.0030 | V: 0.08% |
| H | 0.066 | 0.05 | 1.23 | 0.008 | 0.001 | 0.024 | 0.0028 | REM: 0.0009% |
| I | 0.063 | 0.04 | 1.31 | 0.010 | 0.001 | 0.026 | 0.0024 | Ca: 0.0014% |
| J | 0.064 | 0.89 | 1.26 | 0.010 | 0.001 | 0.034 | 0.0038 | |
| X | 0.210 | 1.51 | 1.49 | 0.010 | 0.001 | 0.033 | 0.0036 | |

The details of the production are shown in Table 3. In this table, "heating rough rolled bar" indicates heating of the rough rolled bar or the rolled steel during the time from the end of rough rolling to the start of finish rolling and/or during finish rolling, and indicates whether or not this heating has been carried out. "FT0" indicates the temperature at the start of finish rolling. "FT" indicates the finishing temperature at completion of finish rolling. "Time until start of cooling" indicates the amount of time from the end of finish rolling until the start of cooling. "Cooling rate from $Ar_3$ to 500° C." indicates the average cooling rate when the rolled steels were cooled in the temperature range from the $Ar_3$ transformation point to 500° C. "CT" indicates the coiling temperature.

As shown in Table 3, descaling was carried out in Example 5 under conditions of a collision pressure of 2.7 MPa and a flow rate of 0.001 liters/$cm^2$ after rough rolling. In addition, zinc plating was carried out in Example 10.

TABLE 3

| No. | Slab No. | Heating rough rolled bar | FT0 (° C.) | FT (° C.) | $Ar_3$ (° C.) | $Ar_3$ + 50 (° C.) | Time until start of cooling (sec) | Cooling rate from $Ar_3$ to 500° C.(° C./sec) | CT (° C.) | Comments |
|---|---|---|---|---|---|---|---|---|---|---|
| | Production Conditions | | | | | | | | | |
| Ex. 1 | A | Yes | 1100 | 860 | 791 | 841 | 1.0 | 200 | 450 | |
| Ex. 2 | A | Yes | 960 | 860 | 791 | 841 | 1.0 | 200 | 450 | |
| Ex. 3 | A | Yes | 1100 | 860 | 791 | 841 | 0.7 | 200 | 450 | |
| Ex. 4 | C | Yes | 1100 | 860 | 788 | 838 | 0.8 | 200 | 450 | |
| Ex. 5 | D | Yes | 1100 | 900 | 816 | 866 | 1.0 | 150 | 400 | *1 |
| Ex. 6 | E | Yes | 1100 | 870 | 723 | 773 | 1.0 | 150 | 400 | |
| Ex. 7 | F | Yes | 1100 | 870 | 809 | 859 | 1.0 | 150 | 400 | |
| Ex. 8 | G | Yes | 1100 | 870 | 803 | 853 | 1.0 | 150 | 400 | |
| Ex. 9 | H | No | 1100 | 870 | 793 | 843 | 1.0 | 100 | 400 | |
| Ex. 10 | I | No | 1100 | 870 | 788 | 838 | 1.0 | 100 | 400 | *2 |
| Comp. Ex. 1 | A | Yes | 1100 | 810 | 791 | 841 | 1.0 | 200 | 450 | |
| Comp. Ex. 2 | A | Yes | 1100 | 860 | 791 | 841 | 0.4 | 80 | 450 | |
| Comp. Ex. 3 | A | Yes | 1100 | 860 | 791 | 841 | 1.0 | 40 | 450 | |
| Comp. Ex. 4 | A | Yes | 1100 | 860 | 791 | 841 | 1.0 | 200 | 600 | |
| Comp. Ex. 5 | B | Yes | 1100 | 890 | 886 | 936 | 1.0 | 70 | <150 | |
| Comp. Ex. 6 | J | No | 1100 | 860 | 813 | 863 | 1.0 | 70 | <150 | |
| Comp. Ex. 7 | X | No | 1100 | 875 | 791 | 841 | 1.0 | 70 | 400 | |

| No. | Micro-Structure | Mean crystal grain size (μm) | Uniformity (ΔHv) | YP (MPa) | TS (MPa) | EI (%) | λ (%) | Bake harden-ability 2% BH (MPa) |
|---|---|---|---|---|---|---|---|---|
| | Microstructure | | | Mechanical Properties | | | | |
| Ex. 1 | Zw + 5% PF | 11 | 7 | 297 | 391 | 36 | 146 | 70 |
| Ex. 2 | Zw + 18% PF | 9 | 13 | 283 | 384 | 37 | 122 | 51 |
| Ex. 3 | Zw + 10% PF | 10 | 11 | 295 | 390 | 36 | 133 | 68 |
| Ex. 4 | Zw | 11 | 8 | 362 | 410 | 34 | 113 | 71 |
| Ex. 5 | Zw | 13 | 7 | 303 | 381 | 37 | 143 | 64 |
| Ex. 6 | Zw | 11 | 9 | 331 | 431 | 33 | 135 | 78 |
| Ex. 7 | Zw | 12 | 10 | 310 | 400 | 36 | 145 | 66 |
| Ex. 8 | Zw | 11 | 9 | 346 | 444 | 33 | 134 | 74 |
| Ex. 9 | Zw + 15% PF | 9 | 14 | 325 | 418 | 34 | 95 | 58 |
| Ex.10 | Zw + 10% PF | 10 | 12 | 355 | 434 | 34 | 110 | 60 |
| Comp. Ex. 1 | 25% PF + Zw | 7 | 25 | 299 | 396 | 37 | 69 | 45 |
| Comp. Ex. 2 | 35% PF + Zw | 6 | 20 | 318 | 404 | 35 | 62 | 45 |
| Comp. Ex. 3 | PF + P | 9 | 28 | 284 | 385 | 38 | 65 | 40 |
| Comp. Ex. 4 | PF + P | 12 | 25 | 280 | 382 | 38 | 62 | 11 |
| Comp. Ex. 5 | PF + M + P | 7 | 38 | 410 | 570 | 24 | 51 | 12 |
| Comp. Ex. 6 | PF + M + P | 7 | 45 | 356 | 614 | 32 | 48 | 45 |
| Comp. Ex. 7 | 50% PF + Zw + 13% $\gamma_r$ | 6 | 34 | 566 | 794 | 33 | 51 | 46 |

*1: Descaling was carried out after rough rolling under conditions of a collision pressure of 2.7 MPa and a flow rate of 0.001 liters/$cm^2$.

*2: The sheet was passed through a zinc plating step.

The bake hardenability and stretch flangability of the hot rolled steel sheets were evaluated in the same manner as the evaluation methods described in the section on carrying out exemplary embodiments of the present invention.

In addition, the microstructures of the hot rolled steel sheets were observed in accordance with the previously described method, and the volume fraction, average crystal grain size of the continuous-cooled microstructure and difference in the average Vickers hardness (ΔHv) were measured.

In Table 3, the results of observing the microstructure are indicated in the columns listed under the heading of "Microstructure". PF indicates polygonal ferrite, P indicates pearlite, M indicates martensite and $\gamma_r$ indicates residual austenite. Zw indicates continuous-cooled microstructure.

Examples 1 to 10 demonstrated tensile strength (TS) of 370 to 490 MPa, and demonstrated hole expanding ratios of 90% or more, indicating superior stretch flangability. The 2% BH amounts, that is BH amount at the preliminary strain of 2%, were also 50 MPa or more, indicating superior bake hardenability as well.

Considering the compositions of the slabs used in the examples, the Al content was 0.015% or less in only Example 4 (slab C). Consequently, the 2% BH amount of Example 4 was 70 MPa or more, allowing the obtaining of even better bake hardenability.

Considering the starting temperature of finish rolling (FT0), the starting temperature of finish rolling (FT0) was lower than 1050° C., namely 960° C., in only Example 2. Consequently, the volume ratio of polygonal ferrite in the microstructure increased, resulting in somewhat inferior bake hardenability as compared with the other examples. The starting temperature of finish rolling is preferably 1050° C. or higher, and as a result, even better stretch flangability and bake hardenability are obtained as those in Examples 1 and 3 to 10.

Considering finishing temperature (FT) at completion of the finish rolling step, the temperature was within the range of 860 to 900° C. in the examples. This is because, slabs having various compositions were used in the examples, and the finishing temperature at completion of finish rolling was determined so as to be equal to or higher than ($Ar_3$ transformation point temperature+50° C.) corresponding to the $Ar_3$ transformation point temperatures determined in accordance with the compositions of the used slabs. In Examples 4 to 8, a microstructure was formed in which polygonal ferrite was not contained and which was only composed of a continuous-cooled microstructure.

Considering the cooling rate in the temperature range from the $Ar_3$ transformation point temperature to 500° C., the cooling rate was less than 130° C. in Examples 9 and 10. In contrast, the cooling rate was 130° C. or more in Examples 1 to 8.

Since the cooling rate was 130° C. or more in Examples 1 to 8, these examples demonstrated small differences in average Vickers hardness (ΔHv) as compared with Examples 9 and 10, and this is thought to have resulted in continuous-cooled microstructure having better uniformity. As a result, Examples 1 to 8 demonstrated better stretch flangability and bake hardenability than Examples 9 and 10.

In addition, in Examples 1 to 8, the rough rolled bar or the rolled steel was heated during the time from the end of rough rolling to the start of finish rolling and/or during finish rolling. As a result, this was thought to have made it possible to adjust the temperature of the rough rolled bar or the rolled steel more accurately; thereby, the occurrence of temperature unevenness and so forth could be inhibited. This is also believed to be a factor in the obtaining of superior stretch flangability and bake hardenability in Examples 1 to 8 as compared with Examples 9 and 10.

In Comparative Example 1, the finishing temperature (FT) at completion of finish rolling was lower than the temperature of ($Ar_3$ transformation point temperature+50° C.). Consequently, polygonal ferrite was included in the microstructure of the produced hot rolled steel sheet at a volume fraction of 25%, thereby the target microstructure could not be obtained. As a result, an adequate hole expanding ratio was unable to be obtained.

In Comparative Example 2, the amount of time from the end of finish rolling to the start of cooling was less than 0.5 seconds. Consequently, polygonal ferrite was included in the microstructure of the produced hot rolled steel sheet at a volume fraction of 35%, thereby the target microstructure could not be obtained. As a result, an adequate hole expanding ratio was unable to be obtained.

In Comparative Example 3, the cooling rate in the temperature range from the $Ar_3$ transformation point temperature to 500° C. was less than 80° C./sec. Consequently, the microstructure of the hot rolled steel sheet produced was composed of polygonal ferrite and pearlite, and the target microstructure could not be obtained. As a result, adequate hole expanding ratio and BH amount were unable to be obtained.

In Comparative Example 4, the coiling temperature (CT) was higher than 500° C. Consequently, the microstructure of the hot rolled steel sheet produced was composed of polygonal ferrite and pearlite, and the target microstructure could not be obtained. As a result, adequate hole expanding ratio and BH amount were unable to be obtained.

In Comparative Example 5, the finishing temperature (FT) at completion of finish rolling was lower than the temperature of ($Ar_3$ transformation point temperature+50° C.), and the cooling rate in the temperature range from the $Ar_3$ transformation point temperature to 500° C. was less than 80° C./sec. In addition, the coiling temperature (CT) was below 350° C. Consequently, the microstructure of the hot rolled steel sheet was composed of polygonal ferrite, martensite and pearlite, and the target microstructure could not be obtained. As a result, adequate hole expanding ratio and BH amount were unable to be obtained.

In Comparative Example 6, the finishing temperature (FT) at completion of finish rolling was lower than the temperature of ($Ar_3$ transformation point temperature+50° C.), and the cooling rate in the temperature range from the $Ar_3$ transformation point temperature to 500° C. was less than 80° C./sec. Consequently, the microstructure of the hot rolled steel sheet was composed of polygonal ferrite, martensite and pearlite, and the target microstructure could not be obtained. As a result, strength was excessively high, and an adequate hole expanding ratio was unable to be obtained.

In Comparative Example 7, the hot rolled steel sheet was produced using slab X, and the content of C was greater than 0.2% by mass. In addition, the cooling rate in the temperature range from the $Ar_3$ transformation point temperature to 500° C. was less than 80° C./sec. Consequently, the microstructure of the hot rolled steel sheet included polygonal ferrite at a volume fraction of 50% and residual austenite at a volume fraction of 13% in addition to the continuous-cooled microstructure (Zw); thereby, the target microstructure could not be obtained. As a result, strength was excessively high, and adequate hole expanding ratio and BH amount were unable to be obtained.

INDUSTRIAL APPLICABILITY

Since this rolled steel sheet has a uniform microstructure capable of demonstrating superior stretch flangability, it can be molded and processed even under conditions in which the steel sheets are required to have high stretch flangability. In addition, even when the steel sheet has tensile strength of 370 to 490 MPa, pressed products can be formed having strength equivalent to pressed products formed using steel sheets having tensile strength of 540 to 640 MPa by introduction of pressing stress and baking finish treatment.

Consequently, this rolled steel sheet can be preferably used as steel sheet for industrial products to which reduction of gauges are strongly required for the purpose of achieving weight saving, as in the case of chassis parts and so forth of automobiles in particular. Moreover, due to its superior stretch flangability, this rolled steel sheet can be particularly preferably used as steel sheet for automobile parts such as inner plate members, structural members and underbody members.

The foregoing merely illustrates the principles of the invention. Various modifications and alterations to the described embodiments will be apparent to those skilled in the art in view of the teachings herein. It will thus be appreciated that those skilled in the art will be able to devise numerous modification to the exemplary embodiments of the present invention which, although not explicitly shown or described herein, embody the principles of the invention and are thus within the spirit and scope of the invention. All publications, applications and patents cited above are incorporated herein by reference in their entireties.

The invention claimed is:

1. A hot-rolled steel sheet having a superior press moldability, a superior bake hardenability, and a superior stretch flangability, the hot-rolled steel sheet comprising:

at least one portion which comprises, in terms of percent by mass,

C of approximately 0.01% to less than 0.1%,

Si of approximately 0.01% to 2%,

Mn of approximately 0.1%to2%,

P of at most approximately 0.1%,

S of at most approximately 0.03%,

Al of approximately 0.001% to 0.1%,

N of at most approximately 0.01%, and

Fe and unavoidable impurities as a remainder, wherein a microstructure of the hot-rolled steel sheet substantially comprises a homogeneous continuous-cooled microstructure in the amount of more than 80% and polygonal ferrite (PF) in the amount of 20% or less, wherein the continuous-cooled microstructure consists of bainitic ferrite ($\alpha^o_B$), granular bainitic ferrite ($\alpha_B$), quasi-polygonal ferrite ($\alpha_q$), residual austenite ($\gamma_r$), and martensite-austenite (MA), and the total amount of residual austenite ($\gamma_r$) and martensite-austenite (MA) is 3% or less, wherein interfaces between hard phases and soft phases do not exist, wherein the difference in average Vickers hardness ($\Delta$Hv) at ¼t and ½t of the sheet thickness (t) and at a depth of 0.2 mm below the surface layer is 15 Hv or less, wherein an average crystal grain size of the microstructure is greater than approximately 8 μm and at most approximately 30 μm;

wherein the bake hardenability of the hot-rolled steel sheet facilitates the hot-rolled steel sheet to obtain a BH amount of about 50 MPa or more, and wherein the hot-rolled steel sheet has a strength of 370 to 490 MPa.

2. The hot-rolled steel sheet according to claim 1, wherein the at least one portion further comprises, in terms of percent by mass, at least one of:

B of approximately 0.0002% to 0.002%,

Cu of approximately 0.2% to 1.2%,

Ni of approximately 0.1% to 0.6%,

Mo of approximately 0.05% to 1%,

V of approximately 0.02% to 0.2%, and

Cr of approximately 0.01% to 1%.

3. The hot-rolled steel sheet according to claim 1, wherein the at least one portion further comprises, in terms of percent by mass, at least one of:

Ca of approximately 0.0005% to 0.005%, and

REM of approximately 0.0005% to 0.02%.

4. The hot-rolled steel sheet according to claim 1, wherein the at least one portion is treated with a zinc plating.

5. A hot-rolled steel sheet having a superior press moldability, a superior bake hardenability, and a superior stretch flangability, the hot-rolled steel sheet consisting of, in terms of percent by mass:

C of approximately 0.01% to less than 0.1%,

Si of approximately 0.01% to 2%,

Mn of approximately 0.1% to 2%,

P of at most approximately 0.1%,

S of at most approximately 0.03%,

Al of approximately 0.001% to 0.1%,

N of at most approximately 0.01%, and

Fe and unavoidable impurities as a remainder, wherein a microstructure of the hot-rolled steel sheet substantially comprises a homogeneous continuous-cooled microstructure in the amount of more than 80% and polygonal ferrite (PF) in the amount of 20% or less, wherein the continuous-cooled microstructure consists of bainitic ferrite ($\alpha^o_B$), granular bainitic ferrite ($\alpha_B$), quasi-polygonal ferrite ($\alpha_q$), residual austenite ($\gamma_r$), and martensite-austenite (MA), and the total amount of residual austenite ($\gamma_r$) and martensite-austenite (MA) is 3% or less, wherein interfaces between hard phases and soft phases do not exist, wherein the difference in average Vickers hardness ($\Delta$Hv) at ¼t and ½t of the sheet thickness (t) and at a depth of 0.2 mm below the surface layer is 15 Hv or less, wherein an average crystal grain size of the microstructure is greater than approximately 8 μm and at most approximately 30 μm;

wherein the bake hardenability of the hot-rolled steel sheet facilitates the hot-rolled steel sheet to obtain a BH amount of about 50 MPa or more, and wherein the hot-rolled steel sheet has a strength of 370 to 490 MPa.

6. The hot-rolled steel sheet according to claim 5, wherein the hot-rolled steel sheet is treated with a zinc plating.

* * * * *